United States Patent [19]

Jackson

[11] 4,441,106

[45] Apr. 3, 1984

[54] ELECTRICAL DISPLAY APPARATUS WITH REDUCED PEAK POWER CONSUMPTION

[75] Inventor: Prentiss W. Jackson, Livermore, Calif.

[73] Assignee: Northern Telecom Limited, Montreal, Canada

[21] Appl. No.: 384,930

[22] Filed: Jun. 4, 1982

[51] Int. Cl.[3] ..... G09G 3/14

[52] U.S. Cl. ..... 340/811; 340/813; 340/802; 340/767; 340/762; 179/99 LS

[58] Field of Search ..... 340/811, 813, 767, 762, 340/761, 782, 802, 812; 179/90 AN, 99 LS, 81 C, 84 L

[56] References Cited

U.S. PATENT DOCUMENTS 3,787,752 1/1974 Delay ..... 340/813
3,909,788 9/1975 Kaelin et al. ..... 340/782
3,986,186 10/1976 Cochran ..... 340/762
4,090,189 5/1978 Fisler ..... 340/813

*Primary Examiner*—Gerald L. Brigance
*Attorney, Agent, or Firm*—Schwartz, Jeffery, Schwaab, Mack, Blumenthal & Koch

[57] ABSTRACT

In an alpha numeric and indicator light emitting diode (LED) display apparatus, a typical flow of displayed information seldom requires that more than half of the LEDs be illuminated. Illuminating current pulses of predetermined duration are directed to selected ones of the LEDs from a power supply normally capable of supplying an average current of up to a predetermined limit, for example up to that which would normally be used to illuminate about half of the LEDs. The display apparatus includes control apparatus for reducing the predetermined duration of the current pulses during an operating condition in which the predetermined limit of the average current would otherwise be exceeded.

6 Claims, 3 Drawing Figures

ELECTRICAL DISPLAY APPARATUS WITH REDUCED PEAK POWER CONSUMPTION

The invention is in the field of electrical display apparatus and more particularly relates to an electrical display apparatus wherein a worse case peak power load demand is reduced without significant sacrifice of display brilliance.

In an electrical display apparatus a plurality of display elements are switchably connected to a power supply in order to visibly display information. In the case of a light emitting diode (LED) display, any one character typically requires that from one to ten LED elements or segments be activated in order that the character be visibly displayed. The number and type of characters and any other indicators which are being displayed determine the instant power required from the power supply to operate the display. A typical flow of alpha numerical display information includes a mix of different characters and some spaces. During most of the operating time of the electrical display apparatus, far less power is required than in an extreme case of a simultaneous display of all of the maximum element characters at all character positions, and all of the indicators. Thus there is a wide variation between average power and peak power demand in the typical operation of LED display apparatus.

This wide variation in the required operating power for an LED display incurs consequences which are illustrated in a consideration of a specific example. Consider for an example a multifunction, multiline telephone station set which includes, a voice circuit, a dial pad, function and line keys and associated LED key indicators, an alpha numeric LED display, a display controller, and a power supply. More specifically, assume that there are 32 LED key indicators, and in the alpha numeric display that there are 16 character positions each including 16 LED elements of which up to 10 elements are utilized at one time to display a character. In this example it is customary to operate an LED key indicator at twice the current of an LED element in the alpha numeric display. It is also customary in the interest of reducing the power requirement to operate the LEDs in a pulse mode. That is to say that each activated display device is periodically illuminated for a short time with the visual sensory perception characteristics of the human observer being relied upon to give an impression of continuous illumination. In this example the worst possible current requirement is a load consisting of 16 characters of 10 LED elements each and 32 LED key indicators. Therefore the maximum possible current requirement is $I(16\times10)+I(32\times2)$, which is 224I. However in the alpha numeric character set the average number of active elements per alpha character is about 6.3. In a normal multikey telephone set operation along with a typical flow of alpha characters a more typical peak load operating condition comprises the illumination of 12 characters of 6.3 elements each, and 11 LED key indicators. Therefore the more typical worse case current requirement is $I(12\times6.3)+I(11\times2)$ which is 97.61. This is much less than half of the worse possible current requirement. However the worse possible current requirement must be satisfied in order that the power supply maintain a required operating voltage and/or not sustain damage. This is particularly so in the case of the telephone station set example wherein the power supply is also required to maintain close voltage tolerances for supplying the display controller, an oscillator in the dial pad and other ancillary circuit loads.

The invention provides an electrical display apparatus normally operable throughout most of its operating regime in conjunction with a power supply for supplying up to a predetermined operating current which is less than that normally required in a maximum worse case load condition.

The display apparatus includes a visual display having a plurality of light emitting devices. A driver circuit is connected to the visual display for directing current pulses of a predetermined duration and on a periodic basis to selected ones of the light emitting devices. A controller includes means for selecting ones of the light emitting devices for illumination and means for directing operation of the drive circuit to cause illumination of the selected ones of the light emitting devices. In accordance with the invention, the display apparatus is characterized by a power supply connected to the driver circuit for supplying operating power at substantially a predetermined voltage and up to a predetermined current, which is less than an operating current which would normally be required to illuminate less than all of the light emitting devices. A first means determines an operating current requirement for the visual display which would normally exceed a predetermined limit. The drive circuit is controlled by a second means for causing the drive circuit to reduce the duration of the current pulses in response to said determination in the first means, whereby the average current used by the visual display is limited to be less than said predetermined current.

In a method of operating a display apparatus current pulses of a predetermined duration are periodically directed to selected ones of light emitting devices. In accordance with the invention, the method is characterized by the steps of:

(a) determining an operating condition wherein an operating current requirement for the selected ones of the light emitting devices would normally exceed a predetermined limit; and (b) reducing said predetermined duration of the current pulses to a lesser duration whereby the average current requirement is less than the predetermined limit.

Example embodiments of display apparatus are described in the following with reference to the accompanying drawings.

Figure 1:
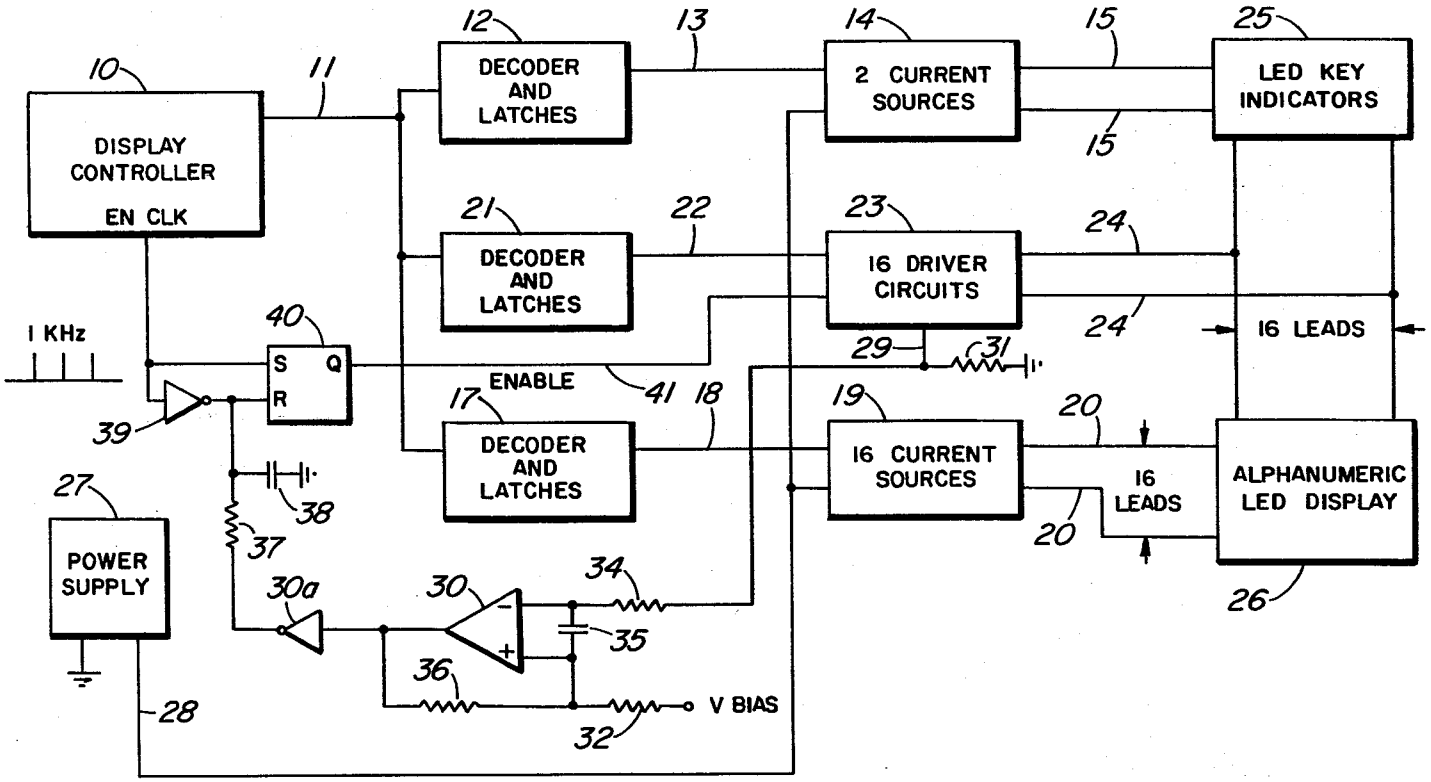
FIG. 1 is a block schematic diagram of a display apparatus in accordance with the invention.

In the drawings only those elements, leads, and power connections which are pertinent to an understanding of the structure and operation of the example embodiments are shown.

Referring to FIG. 1, a display controller 10 is connected by leads 11 to supply binary display control signals to decoder and latch circuits 12, 17 and 21. The decoded binary display control signals are clocked into the latch portions of these circuits on a regular basis, for example at a 1 KHz rate. The latch portions of the circuits 12 and 17 are connected via buses 13 and 18 to control ON OFF states of current sources 14 and 19 respectively. The current sources 14 include two individual current regulators (not shown), each connected to a respective half of a group of thirty-two LED key indicators 25 by respective ones of two leads 15. The current sources 19 include sixteen individual current regulators (not shown) each connected by one of sixteen leads 20 to a sixteen character alpha numeric LED display 26. The latch portions of the circuit 21 are connected to control ON OFF states of driver circuits 23 via a bus 22. The driver circuits 23 include sixteen individual current drivers (not shown), which are each connected via one of sixteen leads 24 to both the LED key indicators 25 and the alpha numeric display 26.

A power supply 27 is connected by a lead 28 to supply operating current via the current sources 14 and 19 to the indicators 25 and the display 26. A current return path from the indicators 25 and the display 26 is provided via the driver circuits 23 and a lead 29 connected in series with a low ohmic value resistor 31. As previously explained, the average power demand for operating the indicators 25 and the display 26 seldom exceeds half of the absolute maximum possible power demand. Therefore in the interest of economy the power supply 27 is provided having an average current capacity of only a little more than half of that which could be drawn by the indicators 25 in combination with the display 26.

Elements 30–40 provide for detection of an excess operating current requirement of the indicators 25 and the display 26, and provide for adjustment of this operating current requirement to a level within the operating current capacity of the power supply 27. These elements include a bilevel comparator provided by a differential amplifier 30 having an inverting input connected to the lead 29 through a resistor 34. A capacitor 35 is connected across the inverting input and a non-inverting input of the differential amplifier 30. A resistor 32 is connected between the non-inverting input and a source of bias voltage V BIAS. A resistor 36 is connected between an output of the differential amplifier 30 and the non-inverting input of the differential amplifier 30. A flip-flop 40 includes a set input (S) connected along with an input of an inverting amplifier 39 to an enable clock (EN CLK) output of the display controller 10. An output of the amplifier 39 is of the open collector configuration and is connected to a reset input (R) of the flip-flop 40. A capacitor 38 is connected between ground and the RESET input. An inverter **30*a* is connected in series with a resistor 37 between the output of the differential amplifier 30 and the RESET input. An output of the flip-flop 40 is connected via an enable lead 41 to the driver circuits 23**.

In normal operation display information in the display controller 10 is time divided into sixteen bytes which are consecutively impressed on the bus 11 during sixteen consecutive one millisecond intervals. The instant information on the bus 11 is decoded and latched by the circuits 12 and 17, with the ON OFF states of the individual ones of the current sources 14 and 19 being governed accordingly. The individual drivers in the driver circuits 23 are likewise controlled by the decoder latches 21 to provide a completion of current paths to ground via the leads 24. Current passing through a light emitting device (LED) in either of the key indicators 25 and the display 26 causes the LED to be illuminated. In this example a LED is periodically illuminated for a period of one millisecond in every sixteen milliseconds. The periodically illuminated LED appears to a typical human observer to be continuously illuminated due to the observer's visual perception.

Considering operation of the circuit elements 30–40, the resistor 37 acts as a pull up resistor for the open collector output of the inverting amplifier 39. Periodic positive clock signals normally available in the display controller 10 are used to set the flip flop 40 via its set input at one millisecond intervals. At the same instant of time the amplifier 39 provides ground at its output, causing the capacitor 38 to be discharged. During the remainder of the one millisecond interval the capacitor 38 is charged through the resistor 37, at a rate dependent upon the RC time constant of these two elements and a voltage at the output of the inverter **30*a*. A voltage is developed across the resistor 31 in proportion to the return current flow on the lead 29. This voltage is filtered by the combination of the resistor 34 and the capacitor 35, having an RC time constant of about one scan period, 16 milliseconds. When the filtered voltage is below the potential of the non-inverting input, the output of the differential amplifier 30 is high, causing the output of the inverter 30*a* to be low, near ground. Hence no significant charge is accumulated by the capacitor 38 in a millisecond period. If the current drawn on the lead 28 is high, the voltage developed across the resistor 31 exceeds the voltage at the junction of the resistors 32, 36 and the non-inverting input, causing the output of the amplifier 30 to be low and the output of the inverter 30*a* to be high. In this case the capacitor 38 accumulates a significant charge. In the one millisecond period the voltage at the reset input of the flip flop 40 is increased beyond a response threshold of the flip flop 40 causing it to be reset. The driver circuits 23 respond accordingly to the reset signal on the enable lead 41 by shutting OFF until the flip flop 40 is set again. This has the effect of reducing the average current from the power supply 27. As the output of the differential amplifier 30 is low, this has the effect of lowering the potential at its non-inverting input, which compensates for the reduction in current flow in the resistor 31. This prevents the circuit from oscillating between normal and current reduced states of operation. When the current drawn on the lead 28 becomes significantly low, the flip flop 40 is no longer periodically reset and the driver circuits 23** are restored to normal full display period operation.

Figure 2:
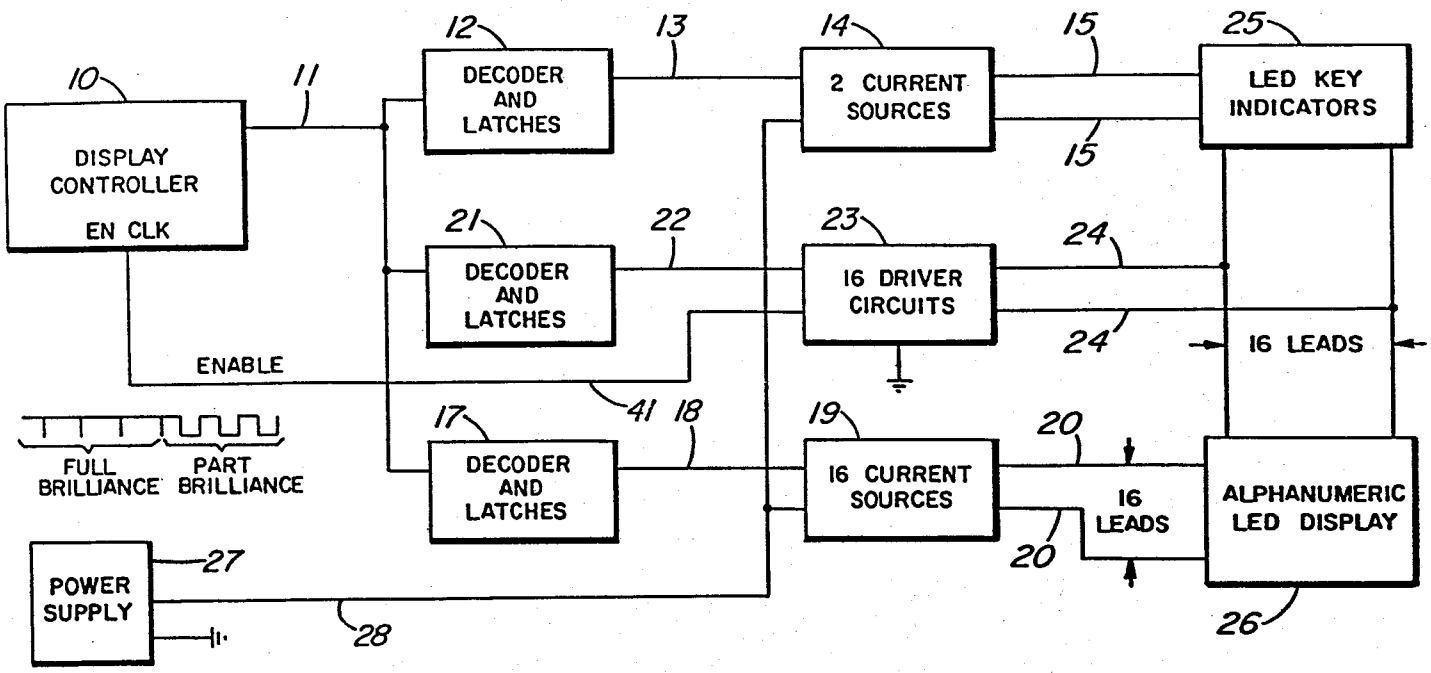
FIG. 2 is a block schematic diagram of another display apparatus, in accordance with the invention.

The display apparatus in FIG. 2 is similar to that illustrated in FIG. 1 except for the following differences. A display microprocessor **10*a* is substituted for the display controller 10 and the function of limiting the display operating current is no longer performed by the circuit elements 30–40 but instead is programmed into an instruction memory (not shown) in the display microprocessor 10*a*. In this case, the actual current from the power supply 27 is not monitored. Instead during the normal operation of the LED key indicators 25 and the alpha numeric LED display 26, the number of LEDs requiring illumination is tallied in the display microprocessor 10*a*. When it is determined that the number of LEDs to be illuminated is excessive, a signal on the enable lead 41 is reduced from almost a one millisecond interval corresponding to full brilliance, to about a one half millisecond interval such that the current drivers 23** are limited to about 50% conduction duty cycle.

Figure 3:
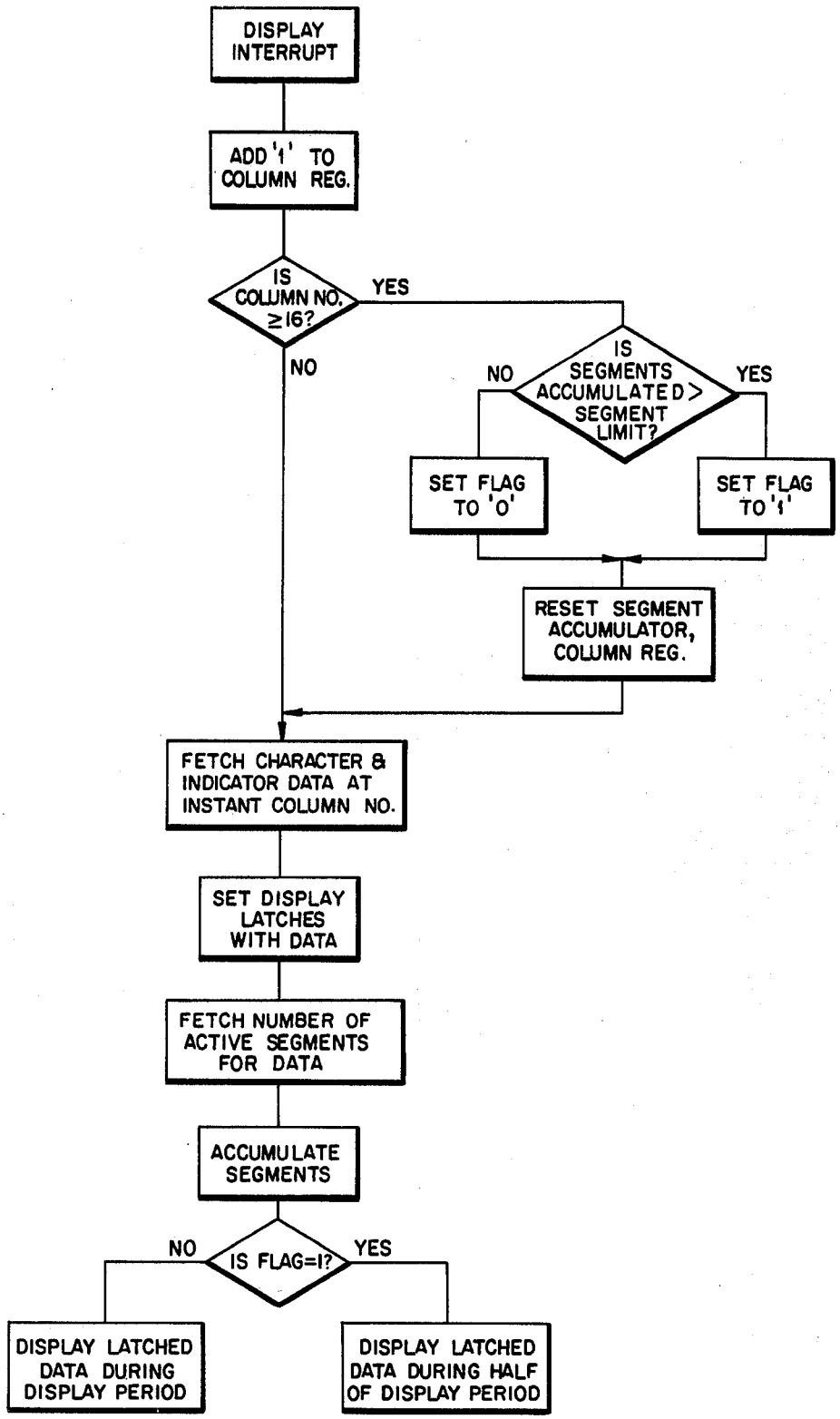
FIG. 3 is a flow chart illustration of part of the operation of the display apparatus in FIG. 2.

The operation of the example embodiment in FIG. 2 is described in more detail with reference to the flow chart in FIG. 3. At 1 KHz intervals the microprocessor **10*a* responds to a display interrupt by adding one to a display column register. If the number in the display colunm register is less than sixteen, character and indicator data are fetched from a display memory at an address corresponding to the instant number in the column register. The data is sent to the decoder latches 12, 17 and 21, causing the latches to be set in preparation to illuminate the required LEDs. The number of active display segments or LEDs corresponding to the data is also fetched and accumulated. The driver circuits 23 are enabled via the enable lead 41** for a full display period in the case where a limit flag is at zero and alternately for a half display period in the case where the limit flag is at one. However if the number in the display column register was sixteen, the number of accumulated segments is compared with a segment limit. If the segment limit has been exceeded, the limit flag is set to one, otherwise it is set to zero. Thereafter the segments accumulated and the display column register are reset to all zeros, and hence the next fetch from the display memory is at the address corresponding to the zero number in the display column register.

What is claimed is :

1. A display apparatus including a visual display having a plurality of light emitting devices, a driver circuit connected to the visual display for periodically directing current pulses of a predetermined duration to selected ones of the light emitting devices, a controller including means for selecting ones of the light emitting devices for illumination and means for directing operation of the drive circuit to cause illumination of the selected ones of the light emitting devices, the display apparatus being characterized by:

a power supply connected to the driver circuit for supplying operating power at substantially a predetermined voltage and up to a predetermined current which is less than that which would normally be required to illuminate all of the light emitting devices;

first means for determining an instant operating current requirement for the visual display which exceeds a predetermined limit; and second means for causing the drive circuit to reduce the duration of the current pulses in response to said determination in the first means, whereby the average current used by the visual display is limited to be less than said predetermined limit.

2. A display apparatus as defined in claim 1 wherein the first means comprises:

a device responsive to the instant operating current of the visual display for generating a potential proportional thereto;

a bilevel comparator circuit having an output for indicating normal and over current states, and being responsive to the potential being in excess of a limit to switch from the normal state to the over current state indicating said determination and being responsive to the potential being less than half of the limit to switch from the over current state to the normal state.

3. A display apparatus as defined in claim 1 wherein the first means provides an essentially binary output signal, one state of which is near ground potential and another state of which indicates an excessive operating current and is of a greater potential than the near ground potential, and wherein the second means comprises:

a network including a resistor and a capacitor and having a selected time constant, the resistor being connected in series with the output of the first means and the capacitor;

a switch being connected to a junction of the resistor and the capacitor in the network, for periodically discharging the capacitor in response to periodic clock signals from the controller;

a bistable circuit including an output connected to a control input of the driver circuit and being responsive to the periodic clock signals from the controller to be in a set state and being responsive to more than a predetermined potential accumulating across the capacitor to be in a reset state in which case the driver circuit is inhibited.

4. A display apparatus as defined in claim 1 wherein the controller is provided by a digital processor and a memory including instruction sets for directing operation of the processor, the display apparatus being further characterized in that the first and second means are provided by a predetermined instruction set in the memory, in combination with the digital processor.

5. A display apparatus as defined in claim 2 wherein the second means comprises:

a network including a resistor and a capacitor and having a selected time constant, the resistor being connected in series with the output of the bilevel comparator circuit and the capacitor;

a switch being connected to a junction of the resistor and the capacitor in the network, for periodically discharging the capacitor in response to periodic clock signals from the controller;

a bistable circuit including an output connected to a control input of the driver circuit and being responsive to the periodic clock signals from the controller to be in a set state and being responsive to more than a predetermined potential accumulating across the capacitor to be in a reset state in which case the driver circuit is inhibited.

6. A method of operating a display apparatus in which illuminating current pulses of a predetermined duration are periodically directed to selected ones of light emitting devices (LEDs), the method being characterized by the steps of :

(a) determining an operating condition wherein an average operating current requirement for the selected ones of the LEDs would normally exceed a predetermined limit; and (b) reducing said predetermined duration of the current pulses to a lesser duration, to prevent the average operating current requirement from exceeding the predetermined limit.

* * * * *